United States Patent [19]

Steel

[11] 3,932,976

[45] Jan. 20, 1976

[54] PREFABRICATED MODULAR STRUCTURAL PANELS

[76] Inventor: John F. Steel, P.O. Box 401, Palm Beach, Fla. 33480

[22] Filed: May 22, 1970

[21] Appl. No.: 39,610

Related U.S. Application Data

[63] Continuation-in-part of Ser. No. 767,890, Sept. 3, 1968, abandoned, which is a continuation-in-part of Ser. No. 652,386, June 14, 1967, abandoned, which is a continuation-in-part of Ser. No. 423,075, Jan. 4, 1965, abandoned.

[52] U.S. Cl. ..... 52/309; 52/536; 52/90; 52/588; 52/630

[51] Int. Cl.[2] ..... E04B 2/10; E04C 1/10

[58] Field of Search ..... 52/309, 588, 540, 542, 52/536, 630, 478, 314, 593, 602, 609, 404; 161/121–123, 159, 160, 161; 156/78, 79; 264/45, 47, 51

[56] References Cited

UNITED STATES PATENTS

| | | | |
|---|---|---|---|
| 2,273,775 | 2/1942 | Strong | 52/314 |
| 2,735,383 | 2/1956 | Gerbracht | 52/478 |
| 3,137,922 | 6/1964 | Schumacher | 52/630 |
| 3,206,902 | 9/1965 | Turnbull | 52/618 |
| 3,290,845 | 12/1966 | Snyder | 52/588 |
| 3,308,004 | 3/1967 | Rouault | 52/309 |
| 3,401,493 | 9/1968 | Linder | 52/309 |
| 3,537,929 | 3/1970 | Keith | 161/161 |

FOREIGN PATENTS OR APPLICATIONS

| | | | |
|---|---|---|---|
| 1,358,344 | 12/1964 | France | 52/309 |
| 433,217 | 11/1935 | United Kingdom | 52/555 |

*Primary Examiner*—John E. Murtagh
*Attorney, Agent, or Firm*—Pennie & Edmonds

[57] ABSTRACT

A self-supporting, modular structural panel comprises a rigid, opaque body panel of substantial thickness. One marginal edge portion of the body panel defines an integral, load-supporting beam which extends outwardly from a first major surface of the body panel. An exterior sheet member is bonded to and conforms to the contour of the body panel and beam. Marginal portions of the sheet are overlapped at an opposite marginal edge of the body panel to define an integral channel portion which extends outwardly from the first major surface of the body panel. The channel portion is configured to receive nestably and to interlock with the beam portion of a second structural member of like configuration.

3 Claims, 10 Drawing Figures

INVENTOR.
JOHN F. STEEL

BY
Pennie, Edmonds, Morton, Taylor & Adams
ATTORNEYS

Fig. 6
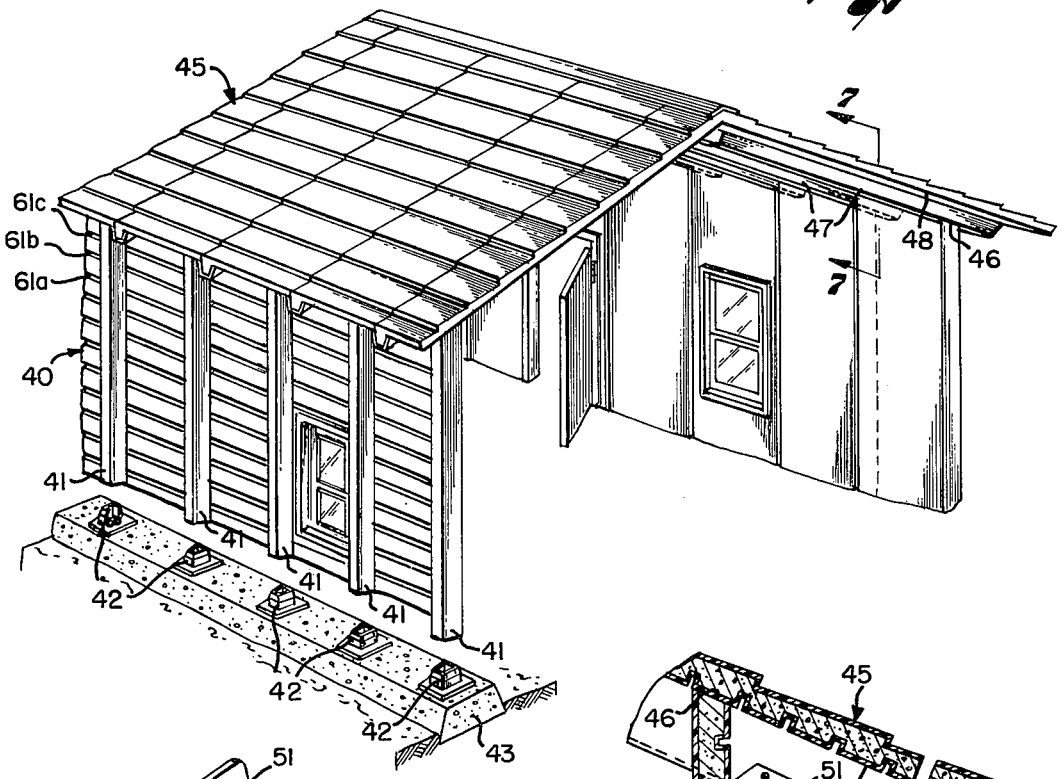
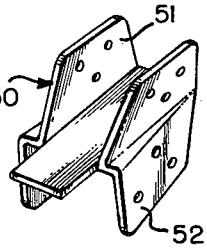
Fig. 8
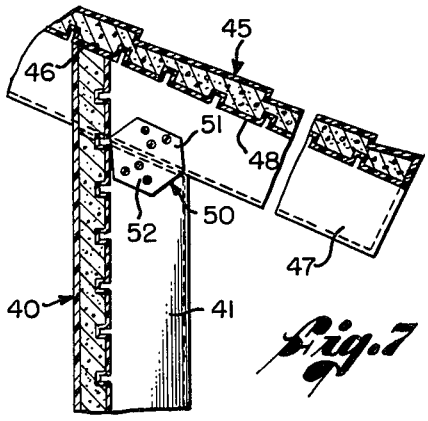
Fig. 7
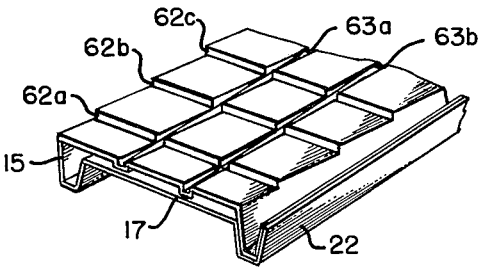
Fig. 9
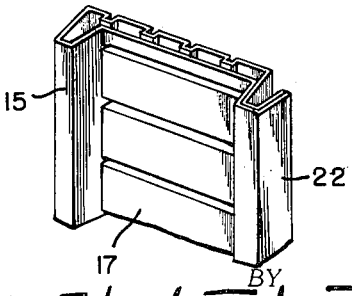
Fig. 10
INVENTOR.
JOHN F. STEEL
BY
Pennie, Edmonds, Morton, Taylor & Adams
ATTORNEYS

PREFABRICATED MODULAR STRUCTURAL PANELS

CROSS-REFERENCE TO RELATED APPLICATIONS

The present application is a continuation-in-part of copending application Ser. No. 767,890, filed Sept. 3, 1968, which is a continuation-in-part of copending application Ser. No. 652,386 filed June 14, 1967 which, in turn, is a continuation-in-part of copending application Ser. No. 423,075, filed Jan. 4, 1965, all now abandoned.

BACKGROUND OF THE INVENTION

The present invention relates to a modular structural panel, and, more particularly to a self-supporting, lightweight, prefabricated structural panel which serves as a modular component for roofs and load-bearing walls.

Construction and maintenance costs for conventional housing are increasing rapidly. Whatever the raw materials employed, considerable time and labor are also required. For these reasons, prefabricated structures have been developed in an effort to minimize construction time and labor costs.

Known prefabrication techniques generally entail manufacture of wall sections from conventional materials prior to erection at the building site. Although such procedures save time and labor, they do not significantly reduce the overall cost of raw materials. Furthermore, the great weight of conventional walls and roofs necessitate costly foundations and associated structure to meet the requirements of applicable building codes.

Because conventional roof and wall structures are extremely poor thermal insulators, excessive heating and air conditioning costs are generally incurred and the poor acoustical characteristics of such conventional structures may be ameliorated only by the use of expensive insulation. Conventional structures tend to deteriorate with time and the cost of preventive maintenance is usually considerable.

Prior attempts at avoiding the disadvantages of conventional building techniques have been limited primarily to the use of relatively bulky prefabricated panels of conventional materials such as wood and steel. Almost invariably, such modular structural systems are not self-supporting and require conventional basic framework, columns and cross-members. U.S. Pat. No. 3,290,845 exemplifies a non-self-supporting modular system, not intended to have substantial load-bearing ability, that requires a special sealing material to provide integrity to the seam between joined modules. Additionally, the core material of such prior modular panel remains exposed to the elements until actual erection at the building site.

SUMMARY OF THE INVENTION

The present self-supporting, modular structural member comprises a rigid, opaque body panel of substantial thickness. A marginal edge portion of the body panel defines an integral load-supporting beam which is substantially coextensive with the marginal edge and extends outwardly with respect to a first major surface of the body panel. A sheet member is bonded to the body panel and beam portion to define the exterior surfaces of the structural member and to conform to the contour of the body panel and the beam portion. Marginal portions of the exterior sheet member are overlapped at an opposite marginal edge of the body panel to define an integral channel portion which is substantially coextensive with the opposite marginal edge and extends outwardly with respect to the first major surface of the body panel. The channel portion is configured to receive nestably and to interlock with the beam portion of a second structural member of like configuration.

The present invention, unlike known prefabricated structures, provides substantial load-bearing ability without the need for conventional framework. Although the present structural panel is light in weight and easily assembled, thus enabling the elimination of expensive foundations and facilitating erection at the building site, the completed structure has superior thermal and acoustical insulation characteristics. The panels are of sufficient thickness and strength to accommodate and to support whatever doors and windows are desired. The completed structure, being substantially monolithic, is entirely weatherproof and because the panels may be fabricated from plastics, the present prefabricated structure is not susceptible to deterioration and decay as in the case of most conventional building materials. Additionally, from the aesthetic standpoint, the present panels may be provided with interior and exterior surface contours to simulate the appearance of any conventional structure. The integral beams may either serve to provide either a rustic interior appearance if left exposed or to support wall panelling of any type if a more finished interior appearance is desired.

BRIEF DESCRIPTION OF THE DRAWINGS

FIG. 6 is a fragmentary perspective view of a monolithic structure of roof and walls of the present invention, and showing windows and doors in frames inserted in wall openings;

FIG. 7 is a fragmentary sectional view taken substantially along the line 7–7 of FIG. 6;

FIG. 8 is a perspective view of an element for joining abutting roof and wall beams;

FIG. 9 is a fragmentary perspective view of an alternate embodiment of the present prefabricated modular roof panel; and FIG. 10 is a fragmentary perspective view of an alternate embodiment of the present prefabricated modular wall panel.

DESCRIPTION OF THE PREFERRED EMBODIMENTS

Figure 1:
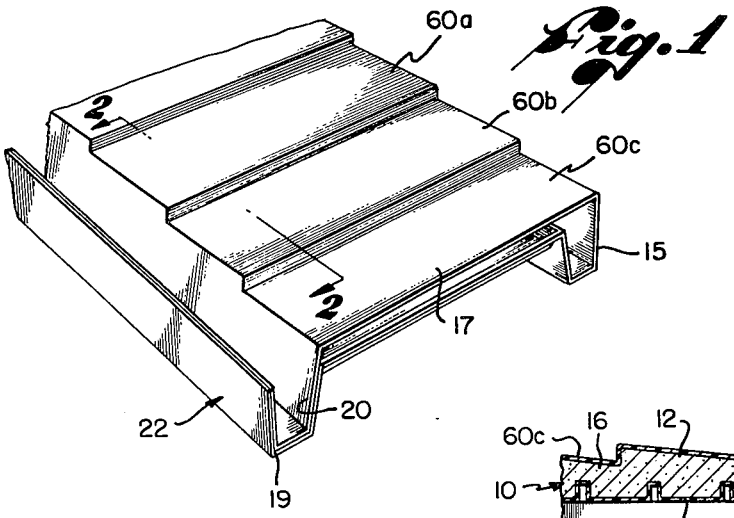
FIG. 1 is a fragmentary perspective view of the present prefabricated modular structural panel.
Figure 2:
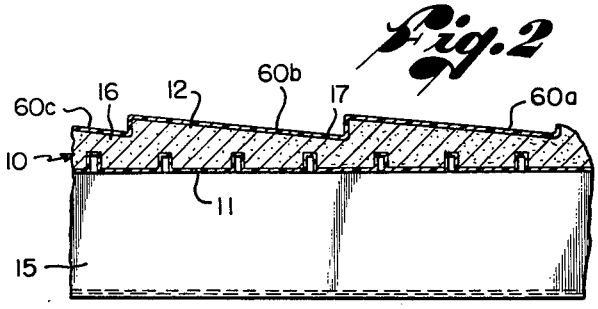
FIG. 2 is a sectional view taken substantially along line 2–2 of FIG. 1.
Figure 3:
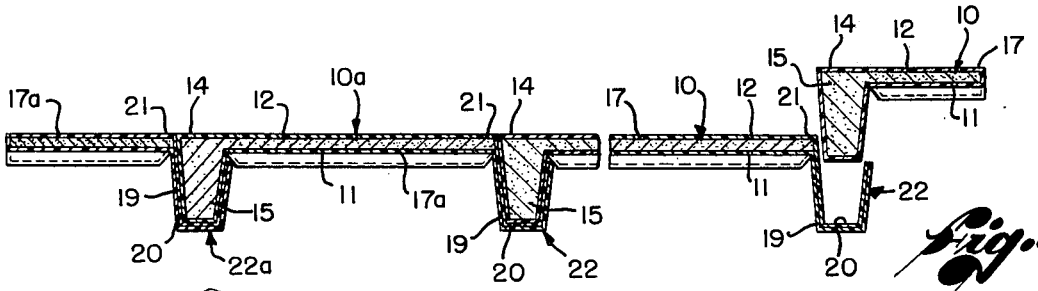
FIG. 3 is a sectional view of a plurality of the present prefabricated modular panels in the process of assembly into roof and wall sections.

Referring particularly to FIGS. 1–3, a self-supporting, modular structural member of the present invention comprises a rigid, opaque body panel 10 of substantial thickness which is preferably constructed of a lightweight, rigid foamed plastic material such as polyurethane. The body panel 10 includes a first major surface 11 which is usually oriented toward the interior of a completed structure and a second major surface 12 which is usually oriented toward the exterior of a completed structure.

A first marginal edge portion 14 of the body panel 10 defines an integral load-supporting beam 15 which is substantially coextensive with the first marginal edge 14 and which extends outwardly with respect to the first major surface 11 of the body panel 10. The beam 15 is preferably trapezoidal in cross-sectional configuration to facilitate joinder with other panels as shall be explained in detail, infra. However, any cross-sectional configuration which serves to provide both simple, rapid assembly and sufficient load-supporting strength may be employed.

A sheet member 17 is bonded to the body panel 10 and the beam portion 15 in surface-to-surface contact to define the exterior surfaces of the structural member and to conform to the contour of the body panel 10 and the beam portion 15. The sheet member 17 is preferably constructed of a rigid plastic material having both suitable structural strength in thin sheets and weather-resistant characteristics. Preferred plastic materials include glass-reinforced polyesters and epoxies. Alternatively, the sheet member 17 may be constructed of a lightweight, corrosion-resistant metal such as aluminum. In practice, the sheet member 17 may be bonded to a pre-formed body panel 10 or, alternatively, the body panel 10 may be formed in situ within a pre-formed sheet member 17. In such case where the sheet member 17 may not be of sufficient rigidity to serve as a mold during in situ foaming of the body panel 10, the sheet member 17 may be supported by placing it within a mold of suitable configuration. Although the body panel 10 and the sheet member 17 are ordinarily self-bonding, particularly if the in situ foaming technique is employed, bonding of the sheet member 17 to the body panel 10 may be facilitated by the use of a suitable adhesive.

Further in aid of achieving superior thermal insulation characteristics, a metallized layer 16 may be incorporated between the exterior sheet member 17 and the second major surface 12 of the body panel 10. Most conveniently, the metallized layer may be applied as a thin sheet or a coating to the inner surface of that portion of the sheet member 17 which confronts the second major surface 12 of the body panel 10. The metallized layer acts particularly to minimize the transfer of heat by solar radiation. As such, it would be required primarily for roof panels.

Figure 4:
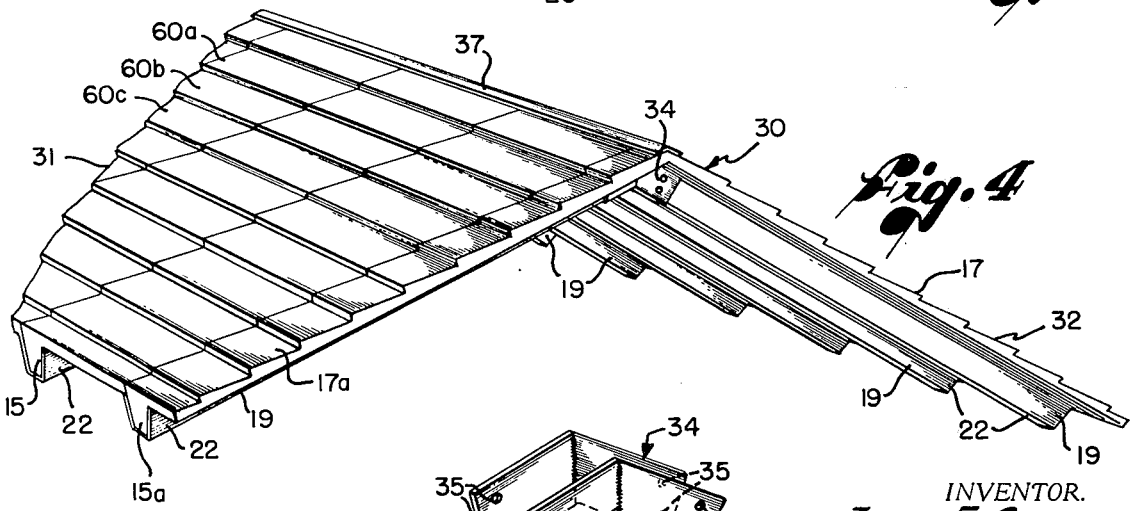
FIG. 4 is a fragmentary perspective view of a roof built of the present prefabricated modular panels.

Marginal portions 19, 20 of the exterior sheet member 17 are overlapped at a second, opposite marginal edge 21 of the body panel 10. The respective overlapped marginal portions 19, 20 are bonded to each other by suitable means, the combined thicknesses providing a dimensionally stable, shape-retaining, integral channel portion 22 which is substantially coextensive with the second marginal edge 21 and which extends outwardly with respect to the first major surface 11 of the body panel 10. The beam 15 and the channel 22 are disposed substantially parallel to each other. The channel portion 22 of each structural member is configured to receive nestably and to interlock with the beam portion 15 of another structural member of like configuration. In practice, the beam portion of one structural member may be permanently secured to the channel portion of another structural member as shown best in FIG. 3, merely by use of suitable adhesive or bonding technique. The resultant structure, as shown in FIGS. 4 and 6, is substantially monolithic and weathertight. No third party sealing material is required to achieve integrity of seams and the portions of the foamed plastic body panel 10 along the marginal edge 14, 21 are not exposed to the elements, even prior to fabrication of the structure at the building site.

Figure 5:
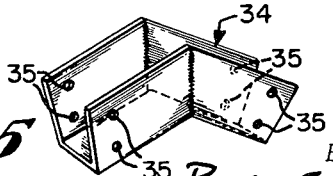
FIG. 5 is a perspective view of an element for joining abutting beams of the two roof panels of FIG. 4.

Referring particularly to FIGS. 4 and 5, a prefabricated roof 30 comprises two abutting sections 31, 32 each of which, in turn, comprises a plurality of the self-supporting modular structural members described, supra. The respective sections 31, 32 are mitered at their abutting marginal edges to achieve a roof having the desired pitch. The abutting marginal edges of the respective sections 31, 32 may be joined together by an angle sleeve 34 which is configured to fit snugly about the surfaces 19 of the respective channel portions 22. Openings 35 in the sides of the sleeve 34 provide means by which conventional fasteners such as nut-and-bolt combinations may be employed to secure the sleeve 34 to the respective structural members, thus locking together the respective abutting roof sections 31, 32.

An additional sealing means for the seam between the respective abutting roof sections 31, 32 is provided by an elongated cap 37 which is coextensive with the peak of the roof and which may be secured in place by adhesive or other suitable means. It is further contemplated that the cap 37 may also include means to permit mechanical interlocking with complementary means which may be provided on the exterior surface of each abutting roof section 31, 32 adjacent the seam.

Referring particularly to FIGS. 3 and 4, transverse marginal structural members each include a rigid, opaque body panel 10*a* and a sheet member 17*a* which defines the exterior surfaces of the structural member and which conforms to the contour of the body panel 10*a*. However, since such structural members are specially constructed to serve as marginal or endmost sections, they include either an integral channel portion 22*a* as shown in FIG. 3 or an integral beam portion 15*a* as shown in FIG. 4. In either case, the endmost exposed marginal edge of the transverse marginal structural member is defined by a portion of the sheet member 17*a* to protect the body panel 10*a* and to insure weathertight construction.

FIG. 6 illustrates a self-supporting vertical wall section 40 comprising a plurality of self-supporting modular structural members described, supra. The lower ends of the beam portions 41 of the wall section 40 are secured to shoes 42 which are in turn anchored in a concrete footing 43. The vertically extending beam portions support the weight of a roof section 45 which is similar in construction to the previously described roof 30 shown in FIG. 4. It is contemplated plated that the uppermost marginal edge 46 of the wall section 40 be cut or mitered at an angle suitable to accommodate the pitch of the roof section 45 and to provide flush contact when the respective sections are joined together as shown best in FIG. 7. The roof beams 47 rest on the mitered uppermost surfaces of the vertical wall beams 41 and the interior surface 48 of the roof section 45 is in flush surface-to-surface contact with the mitered uppermost marginal edge 46 of the wall section 40. The respective sections 40, 45 may be sealed together by a suitable adhesive or by strips of sealing material. Structural rigidity may be further enhanced by the use of a connector 50 shown in FIGS. 7 and 8. A first portion 51 of the connector 50 is configured to conform to the contour of the roof beam 47 and a second portion 52 is configured to conform to the contour of the mitered uppermost portion of the vertical wall beam 41. The connector 50 is provided with means to effect secure joinder with the respective beams 41, 47. In practice, second portions 52 of the connector 50 are secured to a wall beam 41 before the roof section 45 is set in place.

Both the first and second major surfaces 11, 12 of the present structural member may be provided with surface variations to simulate the appearance of conventional materials. In all cases, the surface variations of each structural member register with the surface variations of other structural members of like configuration when the respective members are interlocked as described, supra. Additionally, it is contemplated that colors and surface textures may be imparted to the exterior sheet member to eliminate the need for painting.

The second major [exterior] surface 12 of each structural member of FIGS. 1, 2 and 4, for example, defines a series of steps 60*a*, 60*b*, 60*c*, etc. which extend substantially transversely with respect to the beam portion 15 and the channel portion 22. Further, the first major surface of each structural member comprising the vertical wall section 40 of FIG. 6 defines a series of spaced grooves 61*a*, 61*b*, 61*c*, etc. which extend substantially transversely with respect to the beam and channel portions. As shown best in FIG. 10, spaced grooves may be provided on either major surface and may extend substantially parallel with respect to the beam and channel portions of the structural member. Such spaced grooves further serve to provide reinforcement to the structural member. FIG. 9 illustrates a second major surface configuration which includes a series of transversely extending steps 62*a*, 62*b*, 62*c*, etc. in combination with a series of parallel spaced grooves 63*a*, 63*b*, etc.

FIG. 6 further illustrates the manner in which wall sections of the present structural members may accommodate window and door frames. Roof sections may also be provided with openings in the same manner. Openings for such frames may be cut either when the structural members are constructed or at the building site. In the latter instance, it is preferred that the cut surfaces be faced and bonded with material similar to that of the exterior sheet in order to protect the foamed plastic body panel. Additionally, it is preferred that such openings do not span any of the beams.

Typical dimensions of the present structural member are as follows:

distance between centers of beam and channel: 48 inches.
body panel thickness: 3 inches.
outer beam surface width: 4 inches.
outward extension of beam from first major surface of body panel: 7 inches.
exterior sheet member thickness: 0.062 inches.
groove dimensions: 1 inch depth, 0.5 inch width.

A typical house constructed of sections of the present structural member is 45 feet by 36 feet in overall area; wall height is 8 feet. The roof comprises two sections, each 47 feet by 18 feet in area.

I claim:

1. A self-supporting vertical wall section consisting essentially of a plurality of self-supporting modular structural members, each structural member including a rigid-foamed plastic body panel of substantial thickness, a marginal edge portion of the body panel defining an integral, vertically extending, roof-supporting beam portion which extends outwardly with respect to a first major surface of the body panel; a sheet member bonded to the body panel and beam portion in surface-to-surface contact to define the exterior surfaces of the structural member and to conform to the contour of the body panel and beam portion; marginal portions of the exterior sheet member being overlapped at an opposite marginal edge of the body panel to define an integral channel portion which is substantially coextensive with the opposite marginal edge and extends outwardly with respect to the first major surface of the body panel, the channel portion of each structural member being nestably received and interlocked with the beam portion of another structural member of like configuration.

2. A roof of the type which includes two abutting sections, each section consisting essentially of a plurality of self-supporting modular structural members, each member including a rigid, foamed plastic body panel of substantial thickness, a marginal edge portion of the body panel defining and integral load-supporting beam portion which is substantially coextensive with the marginal edge and extends outwardly with respect to a first major surface of the body panel; a sheet member bonded to the body panel and beam portion in surface-to-surface contact to define the exterior surfaces of the structural member and to conform to the contour of the body panel and beam portion; marginal portions of the exterior sheet member being overlapped at an opposite marginal edge of the body panel to define an integral channel portion which is substantially coextensive with the opposite marginal edge and extends outwardly with respect to the first major surface of the body panel, the channel portion of each member being nestably received and interlocked with the beam portion of another structural member of like configuration.

3. a self-supporting, modular structural member which provides sufficient load-bearing ability to support without additional load-bearing framework a building structure including a plurality of such structural members joined together in interlocking relationship, the structural member comprising a rigid, opaque body panel of substantial thickness, a marginal edge portion of the body panel defining an integral load-supporting beam portion which is substantially coextensive with the marginal edge and extends outwardly with respect to a first major surface of the body panel; a sheet member bonded to the body panel and beam portion in surface-to-surface contact to define the exterior surfaces of the structural member and to conform to the contour of the body panel and beam portion; marginal portions of the exterior sheet member being overlapped at an opposite marginal edge of the body panel to define an integral channel portion which is substantially coextensive with the opposite marginal edge and extends outwardly with respect to the first major surface of the body panel, the channel portion being configured to receive nestably and to interlock with the beam portion of a second structural member of like configuration; and a metallized layer disposed between a second major surface of the body panel and the exterior sheet member.

* * * * *